US007837290B2

(12) United States Patent
Mizes et al.

(10) Patent No.: US 7,837,290 B2
(45) Date of Patent: Nov. 23, 2010

(54) CONTINUOUS WEB PRINTING SYSTEM ALIGNMENT METHOD

(75) Inventors: Howard Mizes, Pittsford, NY (US); R. Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 335 days.

(21) Appl. No.: 12/175,879

(22) Filed: Jul. 18, 2008

(65) Prior Publication Data

US 2010/0013882 A1 Jan. 21, 2010

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 2,686,453 A 8/1954 Bogert
4,322,044 A 3/1982 Bilek
4,675,696 A * 6/1987 Suzuki ..... 346/46
5,250,956 A * 10/1993 Haselby et al. ..... 347/19
5,458,062 A 10/1995 Goldberg et al.
5,729,817 A 3/1998 Raymond et al.
6,633,740 B2 10/2003 Estabrooks
7,056,048 B2 6/2006 Braun et al.
2002/0023558 A1 2/2002 Kusunoki
2007/0229562 A1 10/2007 Doherty et al.

* cited by examiner

*Primary Examiner*—Julian D Huffman
(74) *Attorney, Agent, or Firm*—Maginot, Moore & Beck LLP

(57) ABSTRACT

A method of aligning a printhead is described herein. The method includes accelerating a media along a process path, controlling a first printhead to form a first mark upon the accelerating media, detecting the first mark on the accelerating media, comparing a first mark detection data with first printhead desired alignment data, determining a first correction based upon the comparison of the first mark detection data, and modifying an alignment of the first printhead based upon the determined first correction.

20 Claims, 5 Drawing Sheets

CONTINUOUS WEB PRINTING SYSTEM ALIGNMENT METHOD

BACKGROUND

The method disclosed herein relates to printing systems that generate images onto continuous web substrates. In particular, the disclosed embodiments relate to printhead alignment in such systems.

Printers provide fast, reliable, and automatic reproduction of images. The word "printer" as used herein encompasses any apparatus, such as a digital copier, book marking machine, facsimile machine, multi-function machine, etc. which performs a print outputting function for any purpose. Printing features that may be implemented in printers include the ability to do either full color or black and white printing, and printing onto one (simplex) or both sides of the image substrate (duplex).

Some printers, especially those designed for very high speed or high volume printing, produce images on a continuous web print substrate. In these printers, the image substrate material is typically supplied from large, heavy rolls of paper upon which an image is printed instead of feeding pre-cut sheets from a bin. The paper mill rolls can typically be provided at a lower cost per printed page than pre-cut sheets. Each such roll provides a very large (very long) supply of paper printing substrate in a defined width. Fan-fold or computer form web substrates may be used in some printers having feeders that engage sprocket holes in the edges of the substrate.

Typically, with web roll feeding, the web is fed off the roll past one or more printhead assemblies that eject ink onto the web, and then through one or more stations that fix the image to the web. A printhead is a structure including a set of ejectors arranged in at least one linear array of ejectors, for placing marks on media according to digital data applied thereto. Printheads may be used with different kinds of ink-jet technologies such as liquid ink jet, phase-change ink, systems that eject solid particles onto the media, etc.

Thereafter, the web may be cut in a chopper and/or slitter to form copy sheets. Alternatively, the printed web output can be rewound onto an output roll (uncut) for further processing offline. In addition to cost advantages, web printers can also have advantages in feeding reliability, i.e., lower misfeed and jam rates within the printer as compared to high speed feeding of precut sheets through a printing apparatus.

A further advantage is that web feeding from large rolls requires less downtime for paper loading. For example, a system printing onto web paper supplied from a 5 foot diameter supply roll is typically able to print continuously for an entire shift without requiring any operator action. Printers using sheets may require an operator to re-load cut sheet feeders 2 to 3 times per hour. Continuous web printing also provides greater productivity for the same printer processing speed and corresponding paper or process path velocity through the printer, since web printing does not require pitch space skips between images as is required between each sheet for cut sheet printing.

To achieve the high speeds desired in continuous web printing and to cover the width of the web as required in production printing, multiple printheads are used. As the printer operates, the printheads expand and contract in response to changing thermal conditions. Thus, the width covered by a particular printhead (the "extent" of the printhead) varies depending on the operating temperature. Likewise, the rollers used to define the process path expand and contract in response to temperature changes. The expansion and contraction of the rollers affects the alignment of the process path. "Alignment" as used herein, unless otherwise expressly qualified, is defined as the location of the printhead along the width of the process path immediately adjacent to the printhead (cross-process location), and the orientation of the cross-process axis of the printhead with respect to an axis perpendicular to the edge of the process path. Thus, the web, which is designed to move perpendicularly past each of the printheads, may move past a printhead at a skewed angle when the printhead is misaligned. Additionally, the cross-process extent of the printhead may not be positioned properly with respect to the other printheads.

Misalignment resulting from movement of the printheads and the rollers is exacerbated by the positioning of printheads for different colors at different locations along the process path. Specifically, printers that generate color copies may include one or more printheads for each color of ink used in the printer. Each of the printheads associated with the different colors is positioned at a location along the process path that may be separated from other printheads by one or more roller pairs. Each roller pair produces a unique alignment of the media with respect to the process path. Accordingly, changes in the printheads and rollers may cause the printheads to be misaligned with the web as it moves along the process path.

Alignment of printheads in a printer is typically accomplished by bringing the printer up to its operational speed and printing a series of marks on the continuous web. The positions of the printed marks are detected by a scanner and then analyzed to measure an offset between a desired printhead position and the actual position of the printhead. The printheads are then mechanically moved to the desired position. The printheads may be moved with stepper motors, which in many instances cannot be simultaneously operated. Additionally, the alignment procedure may need to be repeated for a variety of reasons such as excessive measurement noise or backlash of the printhead motor screws. Throughout this process, the image substrate is fed through the device at full speed. Consequently, alignment procedures for printing systems which reduce the waste of media would be beneficial.

SUMMARY

A method of aligning a printhead is described herein. The method includes accelerating a media along a process path, controlling a first printhead to form a first mark upon the accelerating media, detecting the first mark on the accelerating media, comparing a first mark detection data with first printhead desired alignment data, determining a first correction based upon the comparison of the first mark detection data, and modifying an alignment of the first printhead based upon the determined first correction.

In accordance with another embodiment, a printing system includes a process path defined by a plurality of rollers, at least one printhead positioned adjacent to the process path, a linear array sensor positioned along the process path, a memory in which command instructions are stored, and a processor configured to execute the command instructions to accelerate a media along the process path, control the at least one printhead to form a first mark upon the accelerating media, obtain data from the linear array sensor indicative of detection of the first mark, compare the obtained data with data related to the desired alignment of the at least one printhead, determine a first correction based upon the comparison of the first mark, and modify the alignment of the at least one printhead based upon the determined first correction.

In a further embodiment, a method of aligning a continuous web printer includes determining a speed of a media accelerating along a process path, comparing the speed of the accelerating media to a first threshold speed, printing a first test pattern on the accelerating media with a first printhead based upon the comparison to the first threshold speed, detecting the first test pattern, extracting first roll and position data for the first printhead using the detected first test pattern, and adjusting a roll and a position of the first printhead based upon the extracted first roll and position data.

DESCRIPTION

Figure 1:
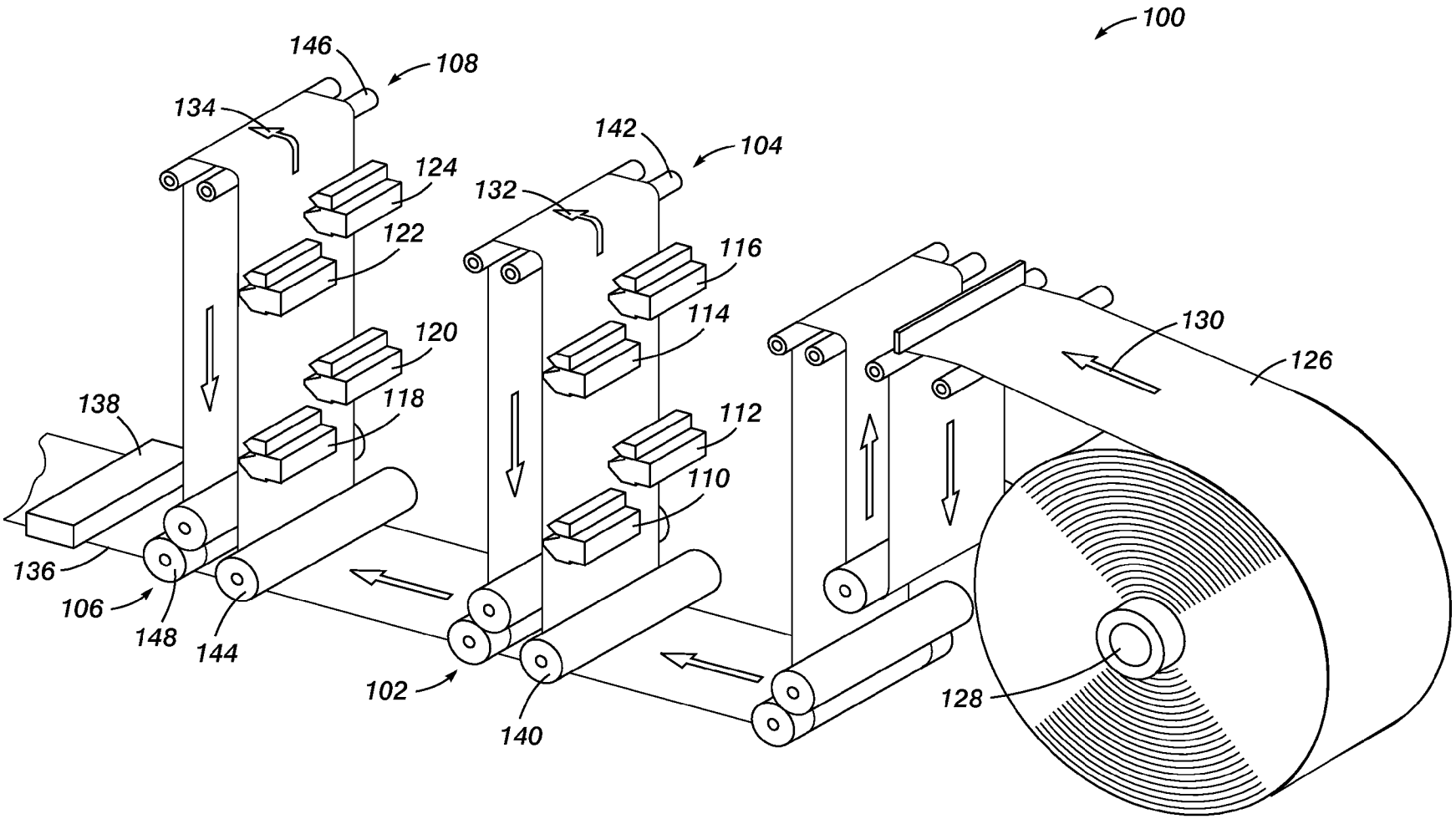
FIG. 1 depicts a partial perspective view of a continuous web printing system with four print stations.

With initial reference to FIG. 1, a continuous web printer system 100 includes four print stations 102, 104, 106, and 108. The print station 102 includes printheads 110 and 112, the print station 104 includes printheads 114 and 116, the print station 106 includes printheads 118 and 120, and the print station 108 includes printheads 122 and 124. A web of print media 126 is positioned on a spindle 128 to provide media for the continuous web printer system 100. The print media 126 is fed along a process path 130 indicated by a series of arrows.

Figure 2:
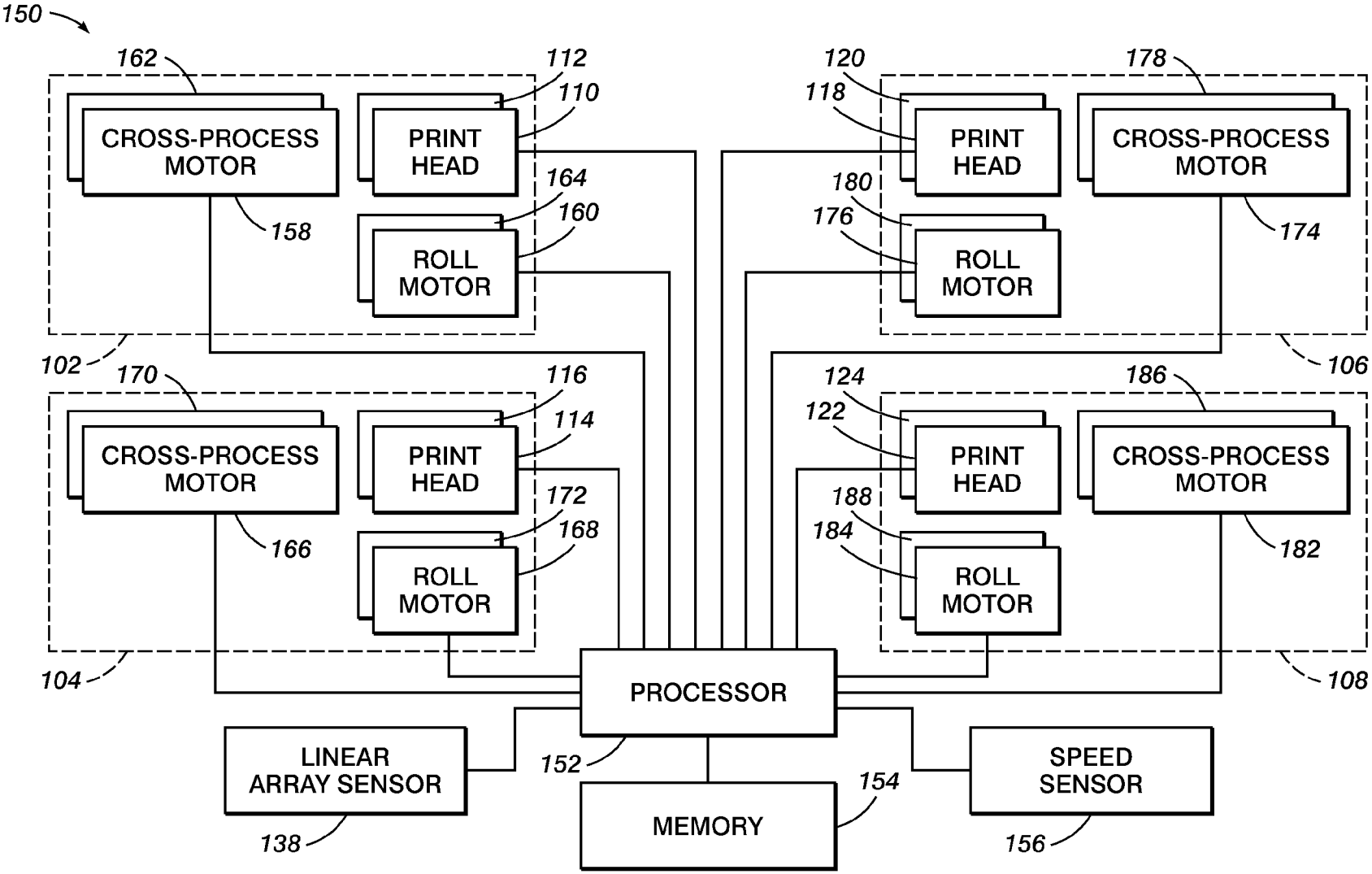
FIG. 2 depicts a schematic of an alignment control system that may be used with the system of FIG. 1.

The process path 130, which is the actual path along which the media 126 proceeds, includes process path segment 132 which is located adjacent to the print stations 102 and 104, and process path segment 134 which is located adjacent to the print stations 106 and 108. A process path segment 136 is located adjacent to a linear array sensor 138. The process path segment 132 is defined by rollers 140 and 142 while the process path segment 134 is defined by rollers 144 and 146. A roller 148 defines, in part the process path segment 136. Alignment of the print stations 102, 104, 106, and 108 with the respective process path segment 132 or 134 is controlled by an alignment control system 150 shown in FIG. 2.

The alignment control system 150 includes a processor 152 and a memory 154. The processor 152 is connected to the linear array sensor 138 and a speed sensor 156 which in this embodiment detects the rotational speed of the roller 140. The processor 152 is further connected to the print stations 102, 104, 106, and 108. Alternative embodiments may include more or fewer printhead stations.

The print station 102 includes a cross-process motor 158 and a roll motor 160 for positioning the printhead 110 along with a cross-process motor 162 an a roll motor 164 for positioning the printhead 112. Likewise, print station 104 includes a cross-process motor 166 and a roll motor 168 for positioning the printhead 114 along with a cross-process motor 170 and a roll motor 172 for positioning the printhead 116, the print station 106 includes a cross-process motor 174 and a roll motor 176 for positioning the printhead 118 along with a cross-process motor 178 and a roll motor 180 for positioning the printhead 120, and the print station 108 includes a cross-process motor 182 and a roll motor 184 for positioning the printhead 122 along with a cross-process motor 186 and a roll motor 188 for positioning the printhead 124. Each of the printheads 110, 112, 114, 116, 118, 120, 122, and 124, the cross-process motors 158, 162, 166, 170, 174, 178, 182, and 186, and roll motors 160, 164, 168, 172, 176, 180, 184, and 188 are controlled by the processor 152.

Figure 3:
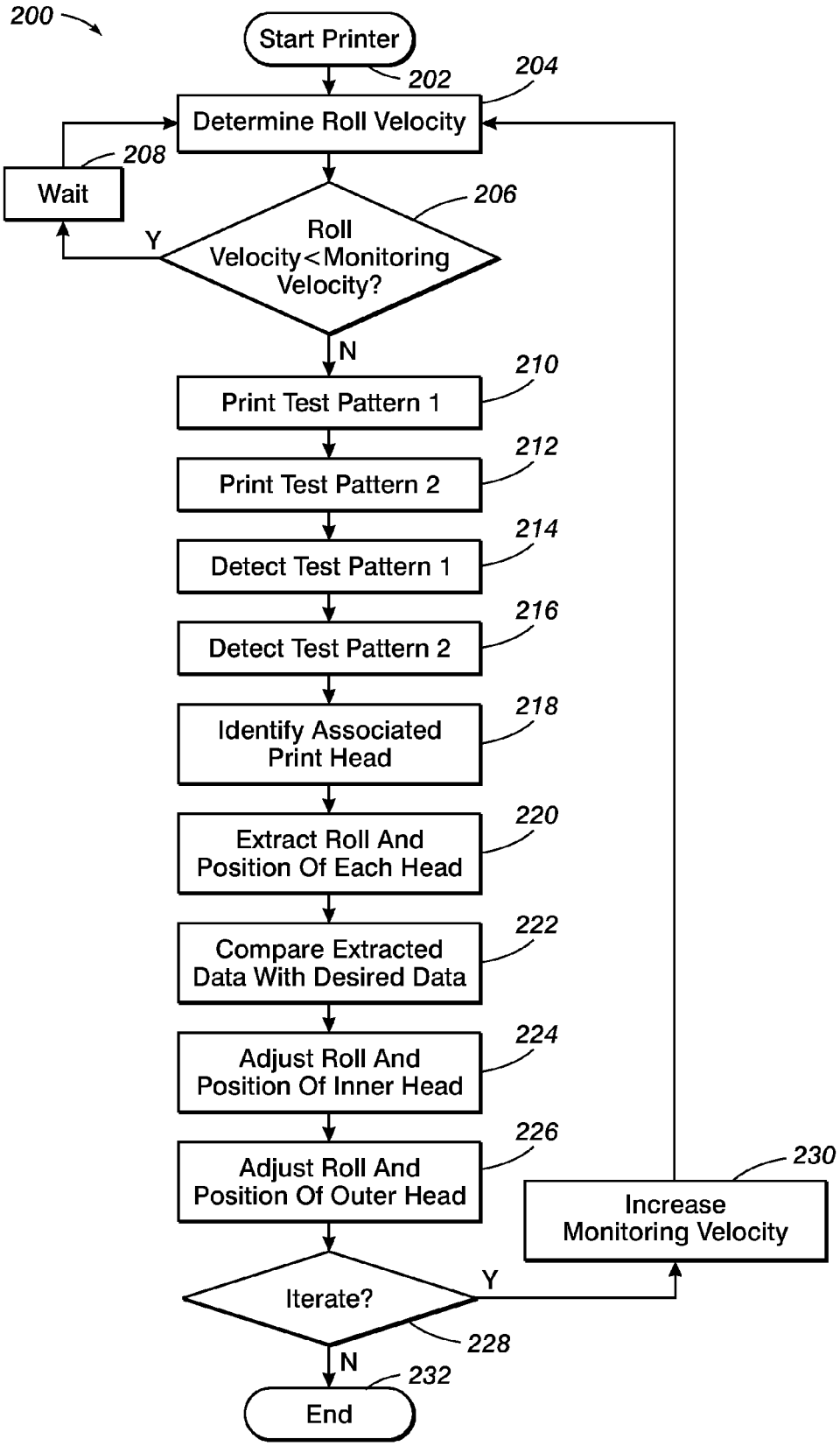
FIG. 3 depicts a flow diagram of an alignment procedure that may be performed by the alignment control system of FIG. 2.

The memory 154 is programmed with command instructions which, when executed by the processor 152, align the printheads 110, 112, 114, 116, 118, 120, 122, and 124. In one embodiment shown in FIG. 3, an alignment process 200 begins when the printer system 100 is energized (block 202) thereby accelerating the media 126 along the process path 130. The movement of the media 126 may be sensed directly or indirectly. In this embodiment, the speed sensor 156 detects the revolutions of the roller 140. The speed of revolution of the roller 140 combined with data for the circumference of the roller 140 can be used to determine the speed of the media 126 along the process path 130 (block 204).

Once data related to the speed of the media 126 along the process path 130 is obtained, the speed data is compared to minimum velocity data stored in the memory 154 (block 206). The minimum velocity data is associated with the minimum speed of the media 126 along the process path 130 for obtaining reliable alignment data. If the determined speed of the media 126 along the process path 130 is too slow, the process 200 waits for a predetermined time (block 208) allowing the speed of the media 126 along the process path 130 to increase. After the predetermined amount of time, the speed of the media 126 is again determined (block 204) and compared to the threshold speed (block 206).

Once the comparison (block 206) reveals that the media 126 is travelling at or above the threshold speed, the processor 152 controls the printhead 110 to generate a test pattern on the media 126 (block 210) and the printhead 112 to generate a test pattern on the media 126 (block 212). As the portion of the media 126 with the test patterns approaches the linear array sensor 138, the linear array sensor 138 is energized. Timing of the energization of the linear array sensor 138 may be based upon the sensed speed along with knowledge of the length of the process path 130 between the particular printhead and the linear array sensor 138. Allowance for the continued acceleration of the media 126 along the process path 130 throughout the procedure 200 is included in determining the energization time.

As the test patterns pass the linear array sensor 138, the test patterns are detected by the linear array sensor 138 (blocks 214 and 216) and data indicative of the detected test patterns are communicated to the microprocessor 152. The processor 152 analyzes the data associated with the test patterns to identify the printhead or heads used to generate the particular pattern(s) (block 218). The processor 152 further uses the data associated with the test patterns to identify cross-process position and roll of the respective printhead with respect to a desired reference (block 220). Comparison of the cross-process position and roll of the respective printhead with the desired cross-process position and roll for the respective printhead (block 222) yields correction data for the respective printhead.

In this embodiment, the correction data for the inner printhead, that is, the printhead closest to the left side of the media 126, is used by the processor 152 to control the respective cross-process and roll motors to align the inner printhead (block 224). The correction data for the outer printhead, along with data associated with the extent of the inner printhead, is used by the processor 152 to control the respective cross-process and roll motors the align the outer printhead with respect to the desired reference (block 226).

The desired reference or references may be defined differently for different systems. Thus, in some systems, the edge of the web media may be used to provide the in-process axis with the cross-process axis perpendicular to the in-process axis. Alternatively, one nozzle of a selected printhead may be designated as the reference and the cross-process position of the other printheads adjusted based upon the location of the designated nozzle. In a further alternative, a sensing member of the linear array sensor may be designated as the reference establishing an in-process axis while the extent of the linear array sensor defines a cross-process axis. In a further alternative, the reference is chosen so that the adjustment of all the heads average to zero.

The memory 154 may include instructions which, when executed by the processor 152, determine whether or not an additional alignment is conducted based upon various criteria. By way of example, a device which has not been running may become misaligned even after an initial correction as the temperature of the various components continues to increase. If the criteria for an additional alignment is met (block 228), then the value of the monitoring velocity is modified (block 230) and the alignment process 200 continues by determining the current speed of the media 126 along the process path 130 (block 204). By selectively adjusting the monitoring velocity (block 230), the number of alignment iterations may be established for a particular system as the system is brought online.

If the criteria for an additional alignment is not met (block 228), the alignment procedure 200 ends (block 232). Thereafter, the media 126 continues to accelerate along the process path 130 until normal operating speed is achieved. The processor 152 then controls the print stations 102, 104, 106, and 108 to complete the print job.

Figure 4:
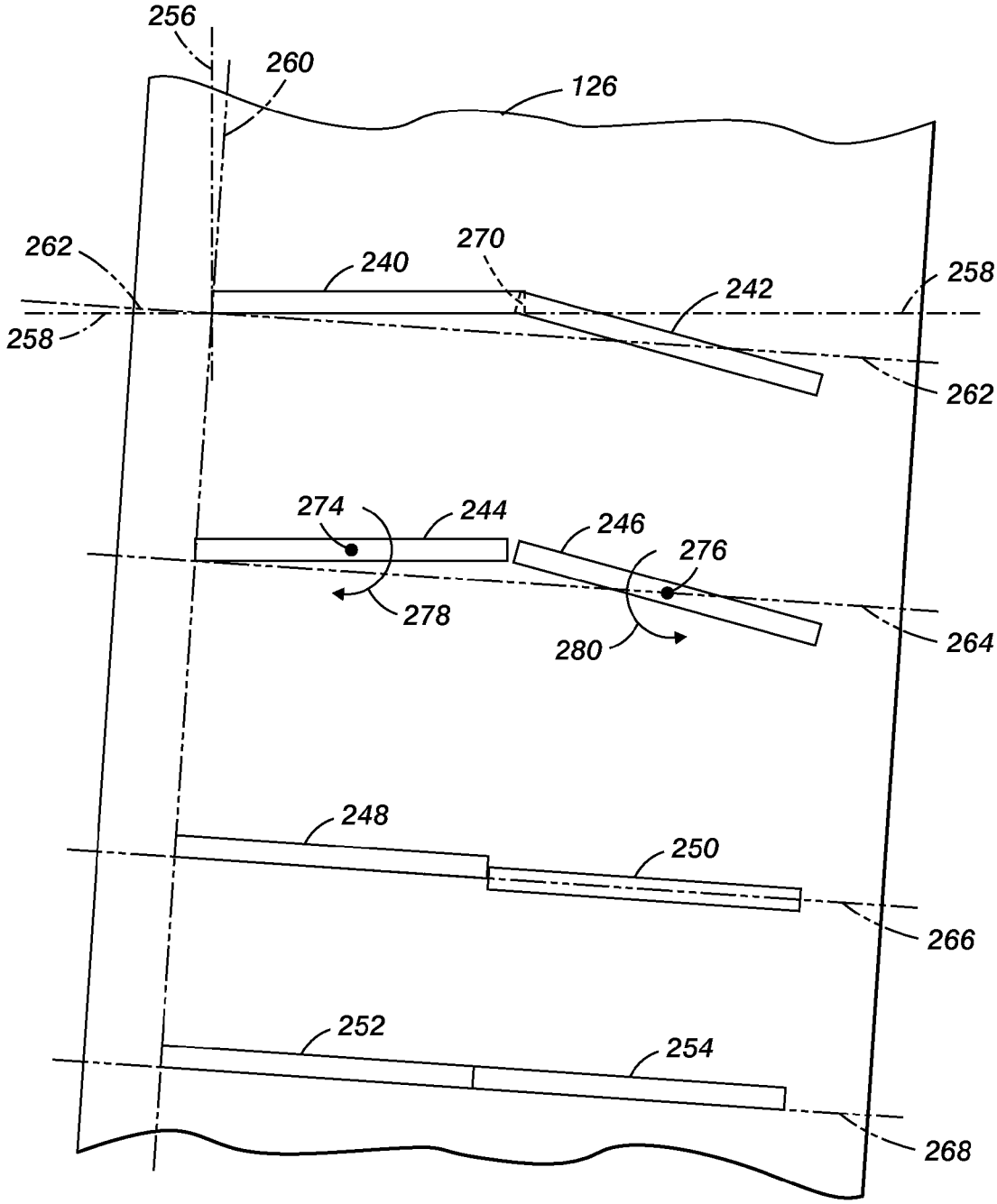
FIG. 4 depicts a top plan schematic view of four test patterns printed on a media by two different printheads wherein the two printheads are initially misaligned.

The alignment procedure 200 may be used to correct a variety of alignment issues on a variety of systems as is explained with reference to FIG. 4. FIG. 4 depicts a portion of the media 126 located at the process segment 136 which is adjacent to the linear array sensor 138. Eight test patterns contained in the regions 240, 242, 244, 246, 248, 250, 252, and 254 are shown on the media 126.

Reference lines 256 and 258 are also shown in FIG. 4. The reference lines 256 and 258 show an in-process axis (256) and cross-process axis (258) to which the printheads in the system 100 were previously aligned for the process path of a previous print job. In this example, the first nozzle of the first printhead is used to define the desired reference. The in-process axis 256 is thus located directly beneath the first nozzle of the first printhead and perpendicular to the cross-process axis 258 when viewed in plan. The reference line 260 also lies directly beneath the first nozzle of the first printhead and is perpendicular to the reference lines 262, 264, 266, and 268 are 260.

Comparing the reference line 256 with the reference line 260 reveals that the in-process axis 260 is rotated from the direction of the in-process axis 256. Thus, while the test pattern 240 is aligned with the reference line 260 in the in-process direction, the test pattern 240 is not aligned with the cross-process axis 262. Additionally, the test pattern 242 is located too close to the reference line 260, resulting in an overlap area 270. The overlap 270 indicates that the printheads 110 and 112, which were used to generate the test patterns 240 and 242, respectively, closer together than desired due to some physical disturbance when they were aligned with the reference lines 256 and 258. Once source of a physical disturbance is a change in temperature.

The test patterns 244 and 246 depict the location of the test pattern marks generated after a cross-process correction has been effected. The test pattern 244 does not change since in this embodiment, the test pattern 244 is formed in part by the reference for the in-process axis. Application of a cross-process correction to the printhead 112, however, moves the printhead 112 away from the printhead 110. Thus, the overlap area 270 has been essentially eliminated.

Both of the test patterns 244 and 246 are rotated with respect to the cross-process axis 264. The test pattern 246, however, is rotated less with respect to the cross-process axis 264 than is the test pattern 244. Application of roll correction pursuant to the procedure 200 to both of the printheads 110 an 112 produces rotation of the printheads 110 and 112, effectively rotating the patterns generated by the printheads 110 and 112 about the axes 274 and 276, respectively, in the direction of the arrows 278 and 280, respectively. In alternative embodiments, printheads may share a common axis of rotation.

The test patterns 248 and 250 are generated after the roll correction has been applied to the printheads 110 and 112. The rotation of the printhead 110 results in the alignment of the test pattern 248 with both the in-process axis 260 and the cross-process axis 266. The rotation of the printhead 112 results in the alignment of the test pattern 250 with an axis that is parallel to the cross-process axis 266.

In the last pair of patterns, the alignment of the test pattern 252 is identical to the test pattern 248. The test pattern 254, however, has been further corrected in the in-process direction with respect to the test pattern 252. Thus, the test patterns 252 and 254 are adjacent to each other. Adjustment along the process path 130 is accomplished by modification of the timing between the jetting of the nozzles on the printhead 110 and the jetting of the nozzles on the printhead 112. Specifically, increasing the delay between jetting of the nozzles has the effect of moving the test pattern generated by the printhead 110 further along the process path 130.

Thus, once the procedure 200 is executed, the width of the images generated by the printheads 110 and 112 are wider than the width of the images formed by the printheads 110 and 112 during the print job using the alignment indicated by the test patterns 240 and 242. Degradation of the image due to printhead overlap, however, is reduced by incorporating additional cross-process correction based upon the extent of the printheads 110 and 112.

Additionally, in the event that the printheads 110 and 112 move closer together due to some physical process, such as perhaps cooling of the print heads, the images formed by the print stations 110 and 112 shrink. Consequently, the cross-process position of the nozzles within the respective printheads is spread more narrowly. This reduction results in a gap area between the patterns formed by the printheads 110 and 112. The procedure 200 may be used to identify and implement appropriate corrections to eliminate any such gap. An image formed subsequent to gap elimination is smaller than an image formed without the correction, but degradation due to gap formation is reduced.

Even though an alignment procedure may be fully accomplished with a single test pattern from each printhead, using each of the nozzles in a printhead during any alignment results in increased ink usage. Moreover, detection of overlap errors such as described above with respect to FIG. 4 is difficult unless the patterns are formed on the media in a staggered fashion. Additionally, care must be taken to ensure that the printed pattern is associated with the proper printhead by incorporating an understanding of the media speed into such association.

Figure 5:
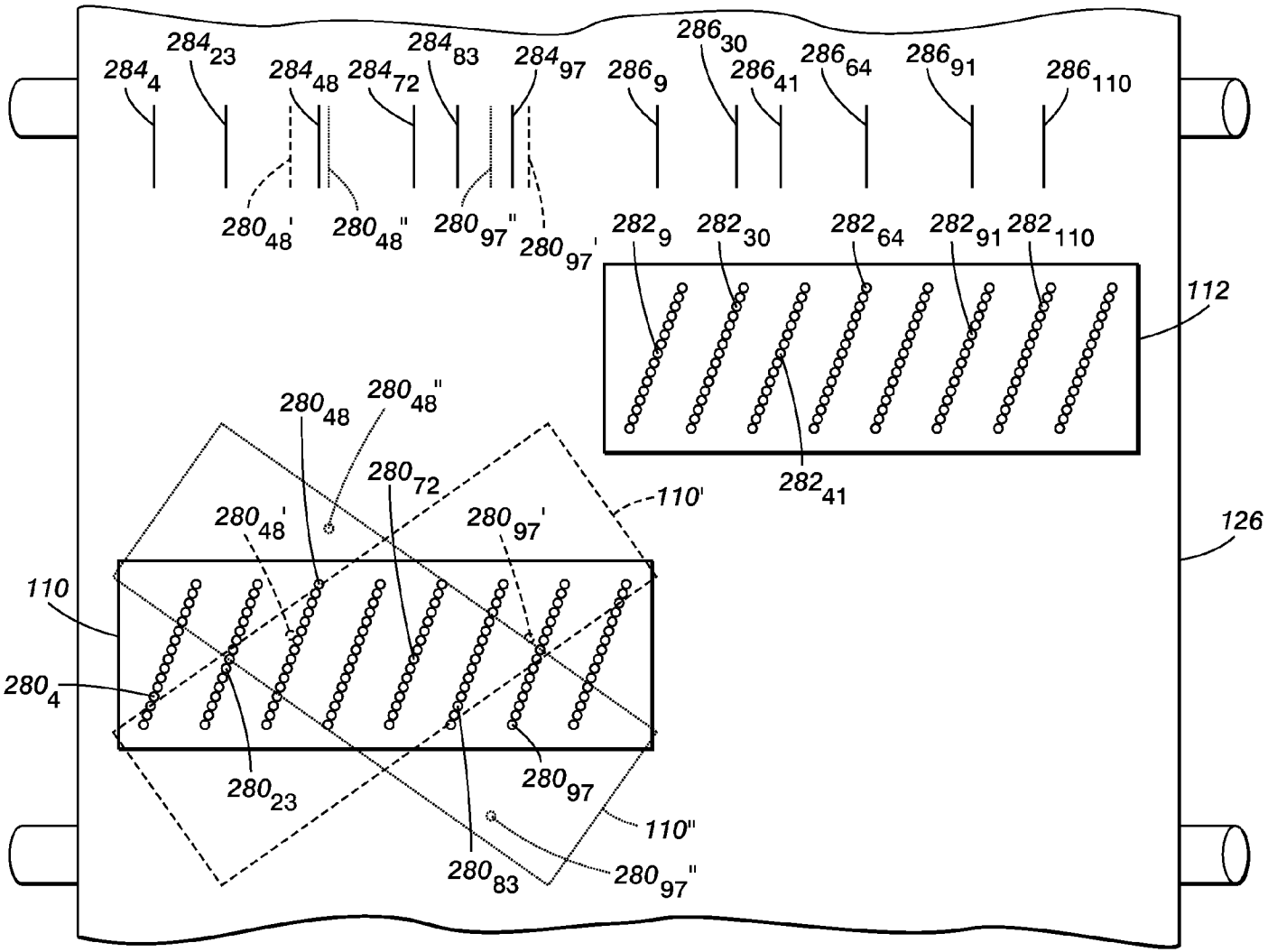
FIG. 5 depicts a top plan schematic view of two test patterns printed on a media by two printheads of FIG. 1 using selected nozzles to generate a series of dashes from each of the printheads.

One approach which ameliorates one or more of the foregoing issues is to use different nozzle groupings for each printhead in forming a test pattern. This approach is described with reference to FIG. 5 wherein the nozzles of the printheads 110 and 112 of the system are shown. The printhead 110 includes eight columns of nozzles $\mathbf{280}_{1\text{-}128}$. Each row column includes 16 nozzles $\mathbf{280}_x$. Likewise, the printhead 112 has eight rows columns of nozzles $\mathbf{282}_{1\text{-}128}$ with 16 nozzles $\mathbf{282}_x$ in each column.

Formation of a test pattern with the printhead 110 is accomplished, in this example, by commanding nozzles $\mathbf{280}_4$, $\mathbf{280}_{23}$, $\mathbf{280}_{48}$, $\mathbf{280}_{72}$, $\mathbf{280}_{83}$, and $\mathbf{280}_{97}$ to fire thereby forming a pattern of lines $\mathbf{284}_x$ on the media 126 wherein each line $\mathbf{284}_x$ is formed by an associated nozzle $\mathbf{280}_x$. Likewise, formation of a test pattern with the printhead 112 is accomplished, in this example, by commanding nozzles $\mathbf{282}_9$, $\mathbf{282}_{30}$, $\mathbf{282}_{41}$, $\mathbf{282}_{64}$, $\mathbf{282}_{91}$, and $\mathbf{282}_{110}$ to fire thereby forming a pattern of lines $\mathbf{286}_x$ on the media 126.

In this embodiment, the printheads 110 and 112 are controlled such that the respective test patterns are formed on the media 126 substantially adjacent to each other. The patterns formed may be distinguished from each other in a number of ways. By way of example, the last nozzle used on the printhead 110 (farthest to the right as viewed in FIG. 5) and the first nozzle used on the printhead 112 (farthest to the left as viewed in FIG. 5) may be selected to ensure that the two patterns cannot overlap along a cross-process axis. Thus, for example, the spacing between the nozzles $\mathbf{280}_{97}$ and $\mathbf{282}_9$ is greater than the total possible misalignment of both of the printheads 110 and 112 with respect to the media 126.

When the patterns $\mathbf{284}_x$ and $\mathbf{286}_x$ are detected by the linear array sensor 138, the spacing between the individual marks (e.g., $\mathbf{286}_9$ and $\mathbf{286}_{30}$) may be used to specifically identify the printhead used to form the marks in a manner similar to a barcode. Once the pattern is associated with the proper printhead, the spacing of the marks and data regarding the particular nozzles fired to generate the marks may be used to extrapolate the cross-process position of each of the nozzles for the particular printhead.

By selectively firing specific nozzles, a roll correction for a particular printhead may be established. Specifically, the distance and orientation between the particular nozzles on a printhead is known. Accordingly, the cross-process spacing between the marks formed by two nozzles may be used to identify the roll of the printhead with respect to the media. By way of example, if the printhead 110 is rotated in a counter clockwise direction to the position of printhead 110', the resultant marks $\mathbf{284}_{48}$' and $\mathbf{284}_{97}$' are spaced farther apart than the marks $\mathbf{284}_{48}$ and $\mathbf{284}_{97}$. Rotation of the printhead 110 in a clockwise direction to the position of printhead 110" results in the marks $\mathbf{284}_{48}$" and $\mathbf{284}_{97}$" which are spaced closer together than the marks $\mathbf{284}_{48}$ and $\mathbf{284}_{97}$.

Additionally, the time between generation of the patterns $\mathbf{284}_x$ and $\mathbf{286}_x$ and the time at which the patterns $\mathbf{284}_x$ and $\mathbf{286}_x$ pass the linear sensor array 138 may be used to determine the speed of the media 126 since the distance between the printheads 110 and 112 and the linear array sensor 138 along the process path 130 is known, albeit the actual speed is constantly changing as the speed of the media 126 along the process path 130 is accelerating. Thus, in embodiments which do not include a speed sensor, so long as the linear array sensor is energized prior to the arrival of a test pattern at the linear array sensor, the speed of the media may be determined.

Once the media speed is known using either a linear array sensor or a speed sensor, jetting of the nozzles may be modified to reduce the amount of ink expended while ensuring a good contrast ratio is presented to the linear array sensor 138. Specifically, the nozzles within the printheads 110, 112, 114, 116, 118, 120, 122, and 124 are configured to provide a desired contrast when the system 100 is operating at normal or target speed. The contrast is achieved by depositing a particular concentration of ink on the media which is established by a designed flow rate of ink. In the event the speed of the media 126 along the process path 130 is less than the normal operating speed, the same concentration of ink may be deposited on the media 126 by selectively de-energizing the nozzle.

One illustration of the foregoing approach is if the normal operating speed of the media 126 along the process path 130 is 100 inches/second, and the instantaneous speed of the accelerating media 126 during an alignment procedure is 25 inches/second. In this situation, the same amount of ink may be deposited on the media 126 during the alignment procedure by jetting the nozzles for ¼ of the time that the nozzles would be jetted if the media 126 was moving at full speed. Thus, a nozzle jetting pattern of 1-on 3-off while forming the test pattern may be used. Of course, the actual speed of the media 126 along the process path 130 during the alignment procedure 200 is constantly increasing. The change in speed during formation of a test pattern, however, will not significantly alter the concentration of ink achieved.

The various steps performed in the procedure 200 may be performed in different order and modified for particular applications in various ways in addition to the variations described above. By way of example, all of the printheads in a system may be controlled to simultaneously print test patterns.

It will be appreciate that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of aligning a printhead comprising:

accelerating a media along a process path;

controlling a first printhead to form a first mark upon the accelerating media;

detecting the first mark on the accelerating media;

comparing a first mark detection data with first printhead desired alignment data;

determining a first correction based upon the comparison of the first mark detection data; and modifying an alignment of the first printhead based upon the determined first correction.

2. The method of claim 1, wherein determination of a first correction comprises:

determining a cross-process correction for the first printhead; and determining a roll correction for the first printhead.

3. The method of claim 1, further comprising:

controlling a second printhead to form a second mark upon the accelerating media;

detecting the second mark on the accelerating media;

comparing second mark detection data with data associated with the first printhead desired alignment data;

determining a second correction based upon the comparison of the second mark detection data; and modifying an alignment of the second printhead based upon the determined second correction.

4. The method of claim 3, further comprising:

modifying the alignment of the second printhead based upon the modified alignment of the first printhead.

5. The method of claim 3, wherein controlling of the first printhead is performed substantially simultaneously with the controlling of the second printhead.

6. The method of claim 1, further comprising:

controlling a second printhead to form a second mark upon the accelerating media;

detecting the second mark on the accelerating media;

comparing second mark detection data with second printhead desired alignment data;

determining a second correction based upon the comparison of the second mark; and modifying an alignment of the second printhead based upon the determined second correction.

7. The method of claim 1, wherein the control of the first printhead comprises:

determining a speed of the accelerating media;

comparing the determined speed to a normal operating speed; and jetting a nozzle of the first printhead using the speed comparison.

8. The method of claim 1, wherein the control of the first printhead comprises:

selecting a subset of nozzles from a set of nozzles in the first printhead; and jetting each of the selected subset of nozzles to form a respective dash in the process direction for each of the selected subset of nozzles.

9. The method of claim 8, further comprising:

associating a detected pattern of dashes with the first print head.

10. A printing system comprising:

a process path defined by a plurality of rollers;

at least one printhead positioned adjacent to the process path;

a linear array sensor positioned along the process path;

a memory in which command instructions are stored; and a processor configured to execute the command instructions to accelerate a media along the process path, control the at least one printhead to form a first mark upon the accelerating media, obtain data from the linear array sensor indicative of detection of the first mark, compare the obtained data with data related to the desired alignment of the at least one printhead, determine a first correction based upon the comparison of the first mark, and modify the alignment of the at least one printhead based upon the determined first correction.

11. The system of claim 10, further comprising:

a speed sensor associated with one of the plurality of rollers for detecting the rotational speed of the one of the plurality of rollers, wherein the processor is further configured to execute the command instructions to control the at least one printhead to form a first mark upon the accelerating media based upon data from the speed sensor.

12. The system of claim 10, wherein the processor is further configured to execute the command instructions to jet each of a selected subset of nozzles from a set of nozzles in the at least one printhead to form the first mark.

13. The system of claim 12, wherein the at least one printhead comprises:

a first printhead positioned at a first location along the process path; and a second printhead positioned at a second location along the process path, the second location positioned upstream of the first location along the process path.

14. The system of claim 12, wherein the at least one printhead comprises:

a first printhead positioned at a first location along a cross-process axis of the process path; and a second printhead positioned at a second location along the cross-process axis of the process path, the second location at a position with respect to the cross-process axis adjacent to the first location.

15. The system of claim 10, wherein the processor is further configured to execute the command instructions to determine a cross-process correction of the at least one printhead, and to determine a roll correction of the at least one printhead.

16. A method of aligning a continuous web printer comprising:

determining a speed of a media accelerating along a process path;

comparing the speed of the accelerating media to a first threshold speed;

printing a first test pattern on the accelerating media with a first printhead based upon the comparison to the first threshold speed;

detecting the first test pattern;

extracting first roll and position data for the first printhead using the detected first test pattern; and adjusting a roll and a position of the first printhead based upon the extracted first roll and position data.

17. The method of claim 16, further comprising:

comparing the speed of the accelerating media with a second threshold speed, the second threshold speed greater than the first threshold speed;

printing a second test pattern on the accelerating media with the first printhead based upon the comparison to the second threshold speed;

detecting the second test pattern;

extracting second roll and position data for the first printhead using the detected second test pattern; and adjusting the roll and position of the first printhead based upon the extracted second roll and position data.

18. The method of claim 16, further comprising:

printing a third test pattern on the media with a second printhead based upon the comparison to the first threshold speed;

detecting the third test pattern;

extracting third roll and position data for the second printhead using the detected third test pattern; and adjusting a roll and a position of the second printhead based upon the extracted third roll and position data.

19. The method of claim 18, wherein adjusting the roll and position of the second printhead further comprises adjusting the position of the second printhead based upon the adjusted position of the first printhead.

20. The method of claim 19, wherein printing a first test pattern comprises:

jetting a nozzle of the first printhead for a duration of time based upon the determined speed.

* * * * *